US007886992B2

(12) United States Patent
Wiseman et al.

(10) Patent No.: US 7,886,992 B2
(45) Date of Patent: Feb. 15, 2011

(54) FLUID EFFECTS PLATFORM WITH A PIVOTALLY-MOUNTED AND REMOTELY-POSITIONED OUTPUT MANIFOLD

(75) Inventors: Evelyn S. Wiseman, Long Beach, CA (US); Theodore R. Carlsson, Long Beach, CA (US); Jennifer M. Magill, Foothill Ranch, CA (US); Michael A. Layman, Huntington Beach, CA (US); William T. Slusser, Garden Grove, CA (US); Jason A. Badger, Anaheim, CA (US); Matthew A. Cotter, Orange, CA (US); Charles P. Davis, Fountain Valley, CA (US)

(73) Assignee: Disney Enterprises, Inc., Burbank, CA (US)

( * ) Notice: Subject to any disclaimer, the term of this patent is extended or adjusted under 35 U.S.C. 154(b) by 164 days.

(21) Appl. No.: 12/333,618

(22) Filed: Dec. 12, 2008

(65) Prior Publication Data

US 2010/0147971 A1 Jun. 17, 2010

(51) Int. Cl.
*B05B 17/08* (2006.01)
*B05B 3/00* (2006.01)
*B05B 15/08* (2006.01)

(52) U.S. Cl. ..... 239/17; 239/18; 239/73; 239/263.1; 239/264; 239/265; 239/587.3

(58) Field of Classification Search ..... 239/12, 239/16–23, 67, 69, 71, 73, 101, 263.1, 264, 239/265, 587.1, 587.2, 587.3, 587.5
See application file for complete search history.

(56) References Cited

U.S. PATENT DOCUMENTS 1,880,272 A 10/1932 Panther, Jr.
2,561,432 A 7/1951 Tranter (Continued)

FOREIGN PATENT DOCUMENTS

DE 102008018118 A1 10/2009

(Continued)

OTHER PUBLICATIONS

European search report (extended) for Application No. 09178090.8-1268 dated Mar. 26, 2010.

*Primary Examiner*—Darren W Gorman
(74) *Attorney, Agent, or Firm*—Marsh Fischman & Breyfogle LLP; Kent A. Lembke

(57) ABSTRACT

A fluid effects apparatus to produce a fluid display or effect. The apparatus includes a base with a center point gimbal. A fluid outlet manifold is provided with an inlet for receiving fluid and an outlet device such as a nozzle for dispersing the received fluid. The fluid outlet manifold is supported upon the center point gimbal to pivot with the gimbal in all directions. A drive assembly is provided with first and second drive mechanisms such as submersible servos that each drive input arms attached to the fluid outlet manifold at an angular offset such as about 120 degrees. The drive mechanisms are separately and concurrently operable to move the input arms to pivot the fluid outlet manifold on the center point gimbal to selectively position the outlet device such as to articulate it in arcs of 110 degrees or more in all directions about a nozzle center axis.

21 Claims, 10 Drawing Sheets

U.S. PATENT DOCUMENTS

| | | | |
|---|---|---|---|
| 2,698,664 | A | 1/1955 | Freeman |
| 3,770,062 | A | 11/1973 | Riggs |
| 3,989,109 | A | 11/1976 | Gagliardo |
| 4,007,793 | A | 2/1977 | Hux et al. |
| 4,892,250 | A | 1/1990 | Fuller et al. |
| 4,955,540 | A | 9/1990 | Fuller et al. |
| 5,078,320 | A | 1/1992 | Fuller et al. |
| 5,115,973 | A | 5/1992 | Fuller et al. |
| 5,553,779 | A | 9/1996 | Fuller et al. |
| 5,934,558 | A | 8/1999 | Samayoa et al. |
| 6,053,423 | A | 4/2000 | Jacobsen et al. |
| 6,085,988 | A | 7/2000 | Marsh |
| 6,131,819 | A | 10/2000 | Fuller |
| 6,151,824 | A | 11/2000 | Clayton |
| 6,267,299 | B1 | 7/2001 | Meyer |
| 6,409,103 | B1 | 6/2002 | Norville et al. |
| 6,592,057 | B1 | 7/2003 | Ericksen et al. |
| 6,955,306 | B2 | 10/2005 | Salvador et al. |
| 7,337,989 | B1 | 3/2008 | Penner et al. |
| 2007/0119977 | A1 | 5/2007 | Wang et al. |

FOREIGN PATENT DOCUMENTS

| | | | |
|---|---|---|---|
| EP | 0994295 | A2 | 4/2000 |

FLUID EFFECTS PLATFORM WITH A PIVOTALLY-MOUNTED AND REMOTELY-POSITIONED OUTPUT MANIFOLD

BACKGROUND OF THE INVENTION

1. Field of the Invention

The present invention relates, in general, to platforms or stages for positioning show or display effects or payloads such as show lights and nozzles for discharging fluid for a water display or fountain, and, more particularly, to a fluid effects platform or stage that is adapted for accurately discharging or dispersing water, flammable fluids, and/or other fluids and the platform or stage may utilize an output manifold that is pivotally mounted to allow positioning in numerous positions.

2. Relevant Background

There is a growing demand for large shows or displays that can be used to entertain audiences and to attract people to particular buildings or locations. Water displays and fountains are often used to create large and breathtaking shows with water and lights that are often accompanied by music being used in a variety of ways to create a crowd-pleasing effect. The water displays are becoming increasingly sophisticated and complicated in design and operation with most water displays including a body of water such as a pool or lake and numerous remotely-controlled nozzles and/or water display devices. The water display devices are often computer controlled to spray or disperse water in a timed or synchronized pattern. Presently-available water display systems have produced useful water displays and shows, but there have been many barriers toward their more widespread adoption and use.

Existing water display devices are typically submerged in a body of water and may be fixed in place or provided on a movable platform. The movable platform is typically raised and lowered by other submerged components to bring the nozzle or water outlet above the surface of the water during the show, and the movable platform is often quite large such as a 5 to 10 foot square platform that contains the nozzle and lighting and other portions of the water display device. Since the platform and device are large, they are often heavy and require relatively bulky equipment to raise and lower in the water.

Another problem facing water display designers is how to provide a moving head or nozzle system that can articulate to numerous positions such as up to 110 degrees in any direction. Such a range of nozzle or water outlet positions is desirable for providing displays and shows with greater variety and allows designers to play with the water to create different looks utilizing fewer fountains or water display devices (and, hence, fewer platforms that have to raised and lowered in the water). Existing devices typically use a single hose to provide water to a nozzle that is mounted on a platform with or without lights. The platform is generally designed to move the nozzle using two assemblies that can be rotated about two separate, perpendicular axes (e.g., rotate about an X-axis and a Y-axis). Such systems allow the direction of the nozzle to be controlled, but these assemblies are generally large and heavy.

Another problem with existing water display systems is alignment of the outlet or nozzle prior to beginning a show or display sequence. For the designed effect to work, it is generally preferably for the nozzle to be returned to a home position such as vertical or with the nozzle pointing upwards. With existing fountains and water displays, the alignment process is very labor intensive and inaccurate as workers generally enter the pond or body of water and try to set the nozzle to a home position by hand. Often, this simply involves "eyeballing" the position of the nozzle to reset it into a desired position while standing in water on a platform or in a boat. Such aligning is then repeated periodically as the equipment may tend to become unaligned with use in shows.

Hence, there remains a need for water or fluid display systems that allow a nozzle or other outlet to be articulated such as up to 110 degrees in an arc. Preferably, such systems would significantly reduce the overall dimensions or size of the outlet positioning equipment and lower the load that needs to be raised and lowered in the water (e.g., to 250 pounds or the like). Additionally, it would be desirable for the fluid display system to include an improved mechanism for aligning the outlet or nozzle or placing it in a home or known position.

SUMMARY OF THE INVENTION

The present invention addresses the above problems by providing a compact water or fluid effects assembly with fewer moving parts. One assembly of the invention includes a fluid inlet manifold (or base) with a center point gimbal (e.g., a ball joint or the like) positioned at or near its top. A fluid outlet manifold with a nozzle or other outlet device is directly and, typically, rigidly connected to the center point gimbal such that the outlet manifold is pivotally mounted and may move in any direction from its center axis (e.g., when it is attached at about a center line to the ball joint or other gimbal device). A drive assembly is included in the effects assembly and includes a pair of drive mechanisms such as submersible servos that function concurrently or independently to move a pair of push/pull rods that are attached to the fluid outlet manifold. The push/pull rods are offset such as 120 degrees from each other as measured from the center axis of the fluid outlet manifold and may be used to push or pull on the manifold to cause it to pivot on the gimbal support so as to accurately position the nozzle (e.g., sweep the nozzle up to 55 degrees or more in any direction from the center axis). A self-dressing or managing hose assembly may be used to connect the inlet manifold to the outlet manifold, and the hose assembly may include a pair of flexible loops of hose extending in a crossing and symmetric fashion between the manifolds to balance application of loads during flow of fluid and movement of the outlet manifold by the drive assembly. In this manner, a fluid effects assembly that may be relatively small (e.g., less than about 3 feet in height and diameter) may be used in place of existing fountain display devices that were typically much larger and bulky with numerous moving parts.

More particularly, a fluid effects apparatus is provided that may be used as part of a show system or fountain to produce a water or other fluid display or special effect. The apparatus includes a base with a center point gimbal mechanism such as, but not limited to, a ball joint. A fluid outlet manifold is provided with an inlet for receiving fluid and an outlet device such as a nozzle for dispersing the received fluid. The fluid outlet manifold is supported upon the center point gimbal mechanism, and, in some embodiments, it is rigidly interconnected to the gimbal such as via a support arm or rod.

The apparatus also includes a drive assembly with first and second drive mechanisms (e.g., submersible servo motors or the like) that each drive input arms or elements that are attached to the fluid outlet manifold at an angular offset such as about 120 degrees. The drive mechanisms are separately and concurrently operable to move the input arms (such as by applying a input force along a linear path with these paths offset by the angular offset) to pivot the fluid outlet manifold on the center point gimbal mechanism to selectively position the outlet device. The outlet device or nozzle may have a range of motion on or about the center point gimbal mechanism that is defined by an angular offset in all directions from a center axis extending through the outlet device, e.g., up to 55 degrees or more in all directions such that a nozzle may be swept or articulated in an arc of up to 110 degrees or more in any direction (or 360 degrees of freedom). The base may include a fluid inlet manifold with an inlet for receiving pressurized fluid and two outlets for discharging the received pressurized fluid, and the base may further include two flexible hoses connecting the two outlets to the inlet of the fluid outlet manifold. The hoses may be self-managing in their arrangement and have a center of gravity that is positioned at an offset angle of about 120 degrees from the input arms of the drive mechanisms.

DETAILED DESCRIPTION OF THE PREFERRED EMBODIMENTS

Figure 1:
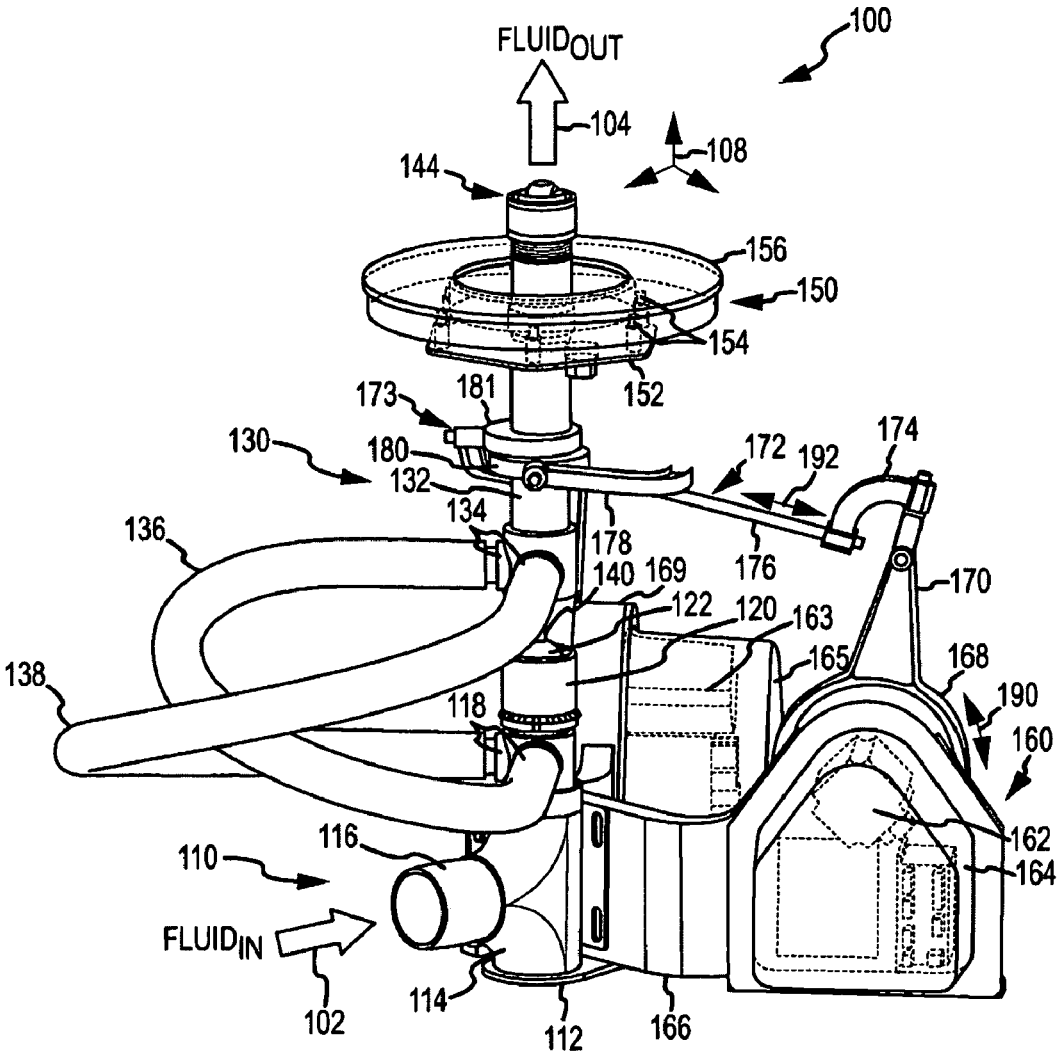
FIG. 1 illustrates a side perspective view of a fluid effects platform or stage of an embodiment of the invention, which may also be labeled a water/fluid display or fountain assembly.

Briefly, embodiments of the present invention are directed to a water display or fountain device that provides a nozzle or outlet device that can be articulated with three degrees of freedom. In some embodiments, it was desired that the nozzle be able to move about 50 to 60 degrees off center in all directions, with center typically being a vertical axis such that the nozzle is directed upward. To this end, embodiments of water display devices described herein provide an outlet manifold that is pivotally mounted on a center point gimbal such as upon a single ball joint or the like, and such mounting allows the outlet manifold to move in multiple directions. Two or more drive arms are connected to the outlet manifold to selectively position the outlet manifold, which typically includes a nozzle or other fluid discharge device, with some embodiments being adapted such that the nozzle may be positioned in or sweep through the 3D space associated with an inverted cone with its point at or near the pivot mounting mechanism. For example, a pair of drive arms may be attached to the outlet manifold with a 120 degree offset from each other and be operated by drive mechanisms such as submersible servo motors to position the outlet manifold or to select a position for nozzle within the cone (e.g., a conical position of the nozzle of up to 55 degrees, for example, off of a center axis in any direction). The water display device may be adapted with an inclinometer such that zero inclination (or vertical/center) can be determined with respect to gravity and the nozzle can be returned to this home position.

A water display or fountain system may include numerous water display devices to create a synchronized show with enhanced movement and/or positioning resolution of the nozzles. The display devices may be used to accurately disperse nearly any fluid with water being just one exemplary use of the display devices described herein. For example, the display devices may be used to disperse flammable fluids. Further, the display devices may also be thought of as fluid effects platforms or stages as nearly any arrangement of components may be provided in the outlet manifold or assembly, and the following figures show a single water nozzle with a lighting assembly but the outlet manifold or assembly may include different discharge mechanisms, two or more nozzles for discharging one or more fluids concurrently or separately, or other equipment useful for creating a particular show or display effect.

FIGS. 1-4 illustrate a fluid effects platform or fluid display assembly 100, which may be used independently or, more typically, together with a number of other fluid effect platforms to provide a fluid display or show. The fluid display assembly 100 includes a fluid inlet manifold 110 and a fluid outlet manifold 130, which, as will be discussed in detail below, is pivotally mounted to the inlet manifold 110 via a center point gimbal. In the illustrated example, this multi-directional gimbal is provided with a ball joint 122 positioned in receiver or support 120 at the top of the inlet manifold 110 and the outlet manifold 130 is directly and rigidly attached to the ball joint 122 with connector or rod 140 such that the outlet manifold 130 is supported by the ball joint 122 and is able to pivot in multiple directions as the ball joint rotates/moves in support 120. A drive assembly 160 is provided in the fluid display assembly 100 to selectively position the outlet manifold 130, with the multi-direction movement/positioning shown with arrows 108.

Figure 7:
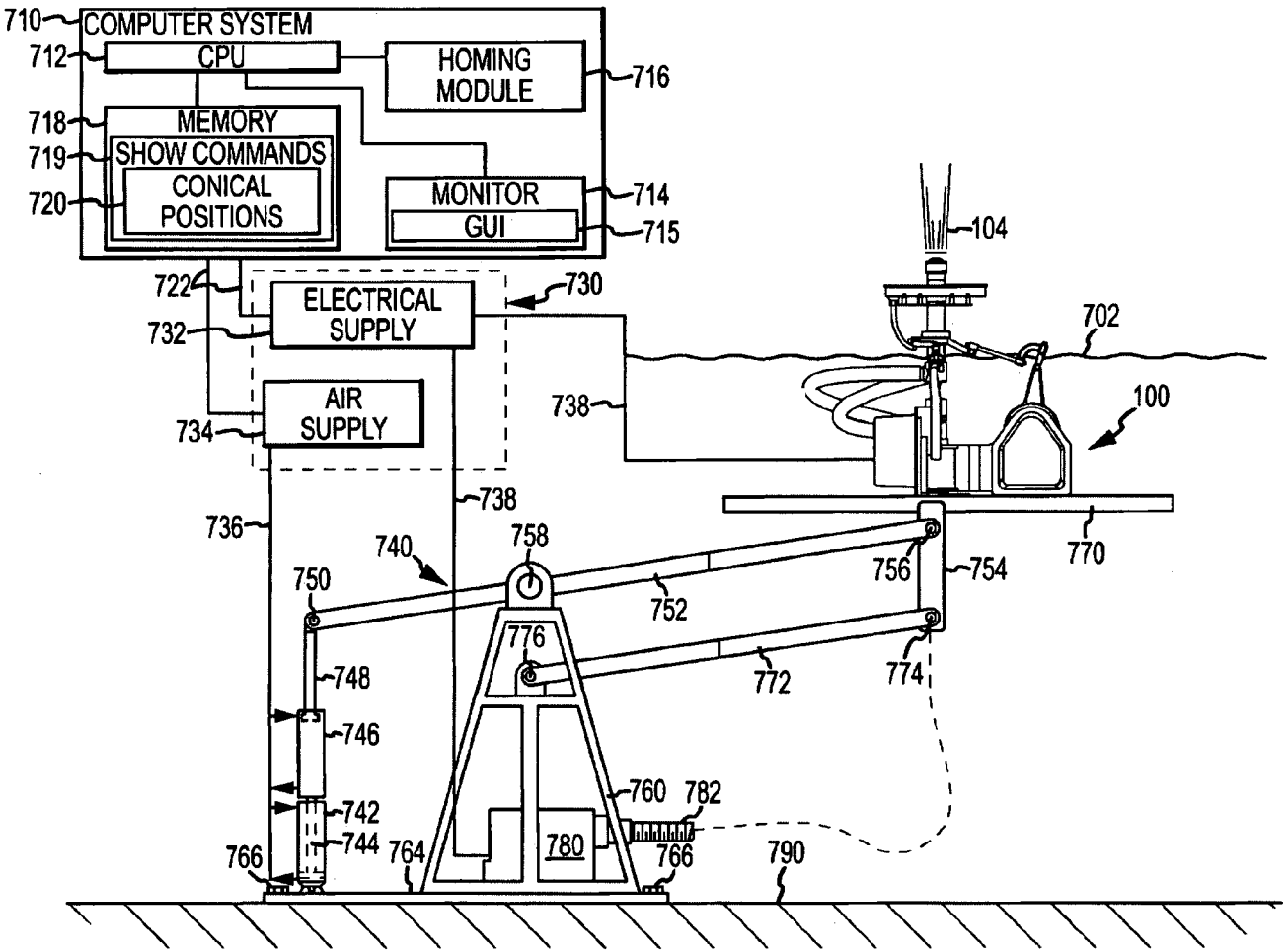
FIG. 7 provides a schematic illustration of a water display or fountain system including components to adjust the physical position of a water display device or fluid effects platform (such as the devices of FIGS. 1-6 or the like) and to remotely control operation of the water display device including positioning of a nozzle within a predefined conical space (in other cases, differing support assemblies may be used as shown in FIGS. 10A-10C)

The inlet manifold 110 includes a base 112 such as a plate that may be adapted for mounting the assembly 100 to another structure such as to a support structure within a body of water or to a platform or other structural member of a positioning mechanism (e.g., to a positionable platform 770 as shown in FIG. 7 that can be raised and lowered such as within a body of water to position the assembly at differing heights relative to a surface of the water 702). The assembly 100 is typically fixed to another structure such that it remains stable when fluid 104 is discharged at high pressure and rates. The inlet manifold 110 also includes a body 114 with fluid channels or passageways and an inlet 116 through which fluid 102 is pumped into the body 114 during operation of the assembly 100 to disperse fluid 104 from the outlet manifold 130. For example, a hose extending from a source of fluid (such as, but not limited to, a pump) may be attached to or clamped onto the inlet 116 to provide the fluid 102 to the inlet manifold 110. The inlet manifold 110 further includes one or more outlets 118 for the fluid 102 to be transmitted to the outlet manifold 130, with two outlets 118 being shown in this example assembly 100. Additionally, the inlet manifold 110 includes a receiver or support element 120 for supporting and containing the ball joint 122 while allowing it to move/pivot within the receiver 120. The fluid 102 is directed through the outlets 118 and is sealed from flowing to receiver 120 (e.g., with an end wall or cap that is in turn attached to the receiver 120 such as through a threaded connection, welding, or the like or the manifold with the receiver 120 may be formed as a unitary component such as via molding).

The fluid outlet manifold 130 is attached to and supported (in part) by the ball joint 122 via connector arm or rod 140. In this manner, the outlet manifold 130 is pivotally supported and mounted within the assembly 100 such that it can move in any direction relative to a longitudinal or central axis extending through the manifold 130 with range of movement being limited and/or controlled by the other portions of the assembly 100 including the drive assembly 160 and fluid tubing 136, 138. Hose management can be problematic with fountain and display devices with moving nozzles and components. Also, the hose or tubing such as tubing or hoses 136, 138 can become relatively heavy when they are filled with water, and this weight can cause loading and/or balance issues. These issues are addressed in the assembly 100 by providing two fluid transfer or feed hoses or lines 136, 138 (but a greater or smaller number may be used in some embodiments) with the arched or bowed arrangement shown in FIGS. 1-4.

The hoses 136, 138 are paired and offset from each other in location to provide symmetric loading or movement resistance/assistance to the inlet manifold 130. In other words, the hoses 136, 138 may be considered "self-dressing" or self-managing of load in part due to the loop configuration, and the hoses 136, 138 are also generally positioned at an angular offset from drive arms/rods 172, 173. In one embodiment, the balance of the assembly 100 is enhanced by providing hoses 136, 138 with a center of gravity about 120 degrees offset (as measured about a center axis of the manifold) from each of the drive arms/rods 172, 173 (which, in turn, are offset from each other by 120 degrees). The hoses 136, 138 are made of a flexible material such as reinforced rubber or plastic, with one embodiment using 2-inch PVC hose, and selected to withstand the operating pressures and flow rates of the assembly 100, which may be relatively high to achieve desired fluid displays or effects. The hoses 136, 138 are each connected at a first end to the inlet manifold 110 at outlets 118 and at a second end to the fluid outlet manifold 130 at fluid inlets 134 in body 132. The arrangement of the hoses or the hose configuration is believed highly beneficial to the assembly 100, as the hose configuration provides complete freedom of motion with a minimum of hose length and movement and with no stress or wear on the hoses 136, 138.

The body 132 is rigidly attached to or connected to the connector arm or rod 140 such that the body 132 is interconnected with the pivot member (e.g., ball joint) 122. The body 132 includes channels or passageways for allowing fluid received from the hoses 136, 138 to flow through the body 132 and to an outlet device 144 (e.g., a fluid nozzle or the like attached to or provided as part of the body 132) where it is dispersed or discharged as shown at 104. The outlet manifold 130 may take many forms to practice the invention such as the elongate body 132 as shown, and a single nozzle or outlet/discharge device 144 may be provided at the end of the body 132 or two or more of such devices 144 may be provided. In addition to discharging fluid, the assembly 100 may allow other payload to be positioned by pivoting the body 132. For example, as shown, a light ring or assembly 150 may be attached to the body 132 (or otherwise supported by outlet manifold 130) via plate or collar 152. Lights 154 such as LEDs or the like may be positioned on this plate 152 and an optional light output element 156 covering the lights 154, and the lights 154 may be powered with a local power source or a remote source (e.g., power typically will be run to or provided to drives 162, 163 and may also be provided to lights 154). The lights 154 are typically remotely controlled/operated such as in a manner that is synchronized with discharge of fluid 104 to create a desired light/fluid effect or display (e.g., see computer system 710 of FIG. 7 that may be used to control operation of the lights 154 in ring 150). In some embodiments, the fluid 104 is flammable and the payload provided on the stage or assembly 100 may include ignition devices (not shown) to ignite the fluid 104 as it is discharged from the outlet 144.

The fluid display assembly 100 includes a drive assembly 160 to selectively position the outlet manifold 130 and attached nozzle 144. As will be discussed with reference to FIGS. 5 and 6, the body 132 of outlet manifold 130 is pivoted on ball joint 122 such that the nozzle 144 and manifold 130 can be moved up to some predefined amount or angle in any direction from center (e.g., the home position shown with the body 132 and nozzle 144 generally pointing up or vertical), e.g., up to 55 to 60 degrees or more in all directions. The body 132 and nozzle 144 may be thought of as sweeping an inverted cone about the pivot connection or the nozzle may be thought of as being articulated up to 110 to 120 degrees or more in an arc. In some embodiments, the positioning of the body 132 and attached nozzle 144 is set by conical positions or 3D coordinates that are used to operate the drive assembly 160 to position the nozzle 144.

The drive assembly 160 is configured to drive or position the outlet manifold 130 with input forces provided at opposing axes separated by an offset angle, $\theta$, which may vary to practice the invention. In one embodiment, the offset angle, $\theta$, between the input or driving forces is set at 120 degrees (plus or minus 10 degrees). This provides a balanced or symmetric application of loads and allows the outlet manifold 130 to be positioned accurately in any position within a 3D conical space.

As shown, the drive assembly 160 includes first and second drive mechanisms 162, 163, which may be DC servo motors, AC stepper motors, or the like. The drive mechanisms 162, 163 may be specially adapted for submersion and/or are placed inside sealed housings 164, 165, which are attached to the inlet body 114 with wing elements or connectors 166, 167. At the motor/drive outputs, a drive plate 168, 169 is provided that rotates 190, 191 in response to operation of the motors or drive mechanisms 162, 163, and an extension 170, 171 protrudes from the plate 168, 169 to allow this rotational movement to be translated into a linear movement/motion 192, 193 that can be applied to the manifold body 132 to position the outlet manifold 130. The positioning or driving force is applied to the manifold 130 via positioning assemblies 172, 173, which as shown may generally be thought of as a pair of push/pull rods 172, 173 that are connected to the rotating drives 162, 163 via curved arms 174, 175, swing arms 176, 177, 178, 179, and collars 180, 181.

Figure 2:
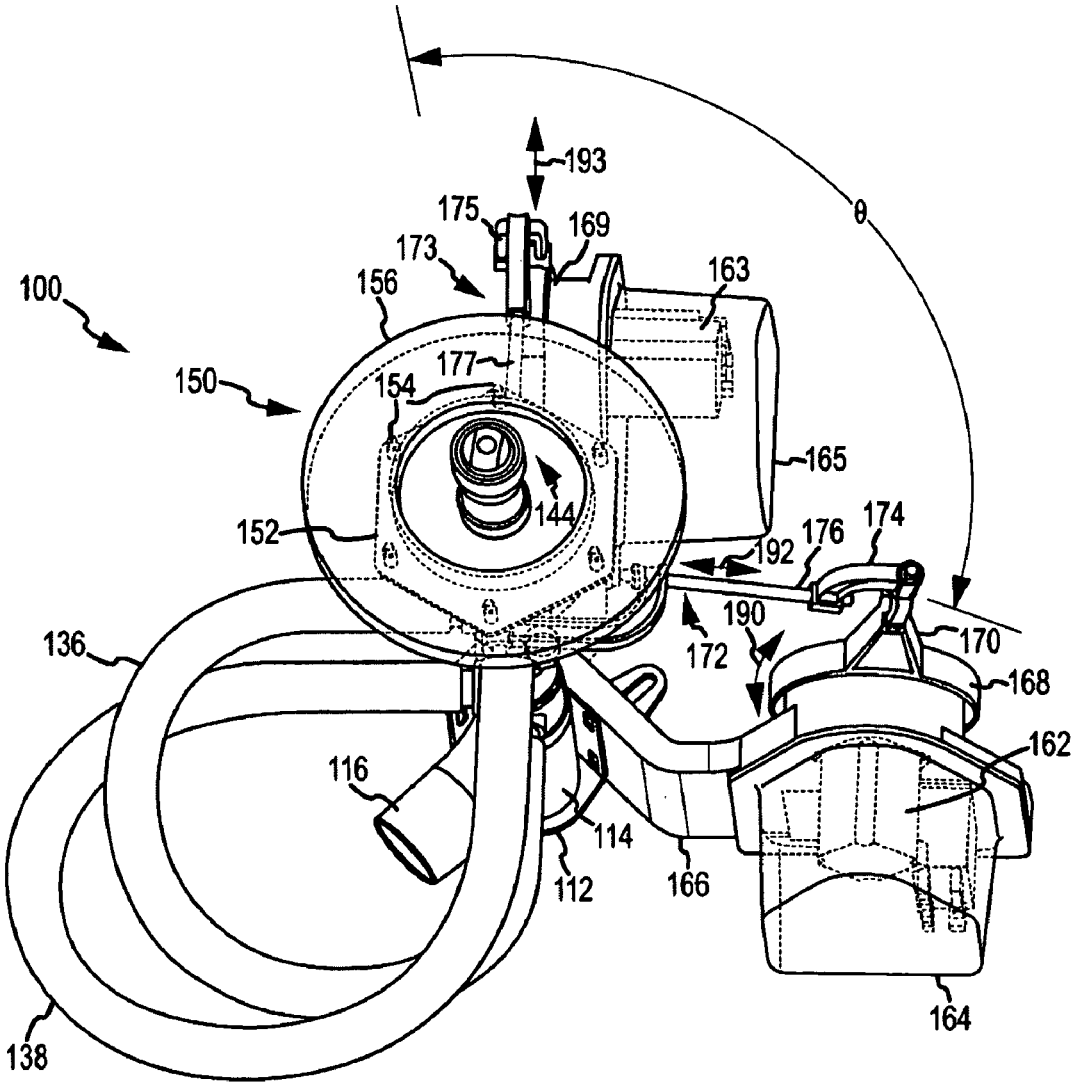
FIG. 2 is top view of the fluid effects platform of FIG. 1.
Figure 3:
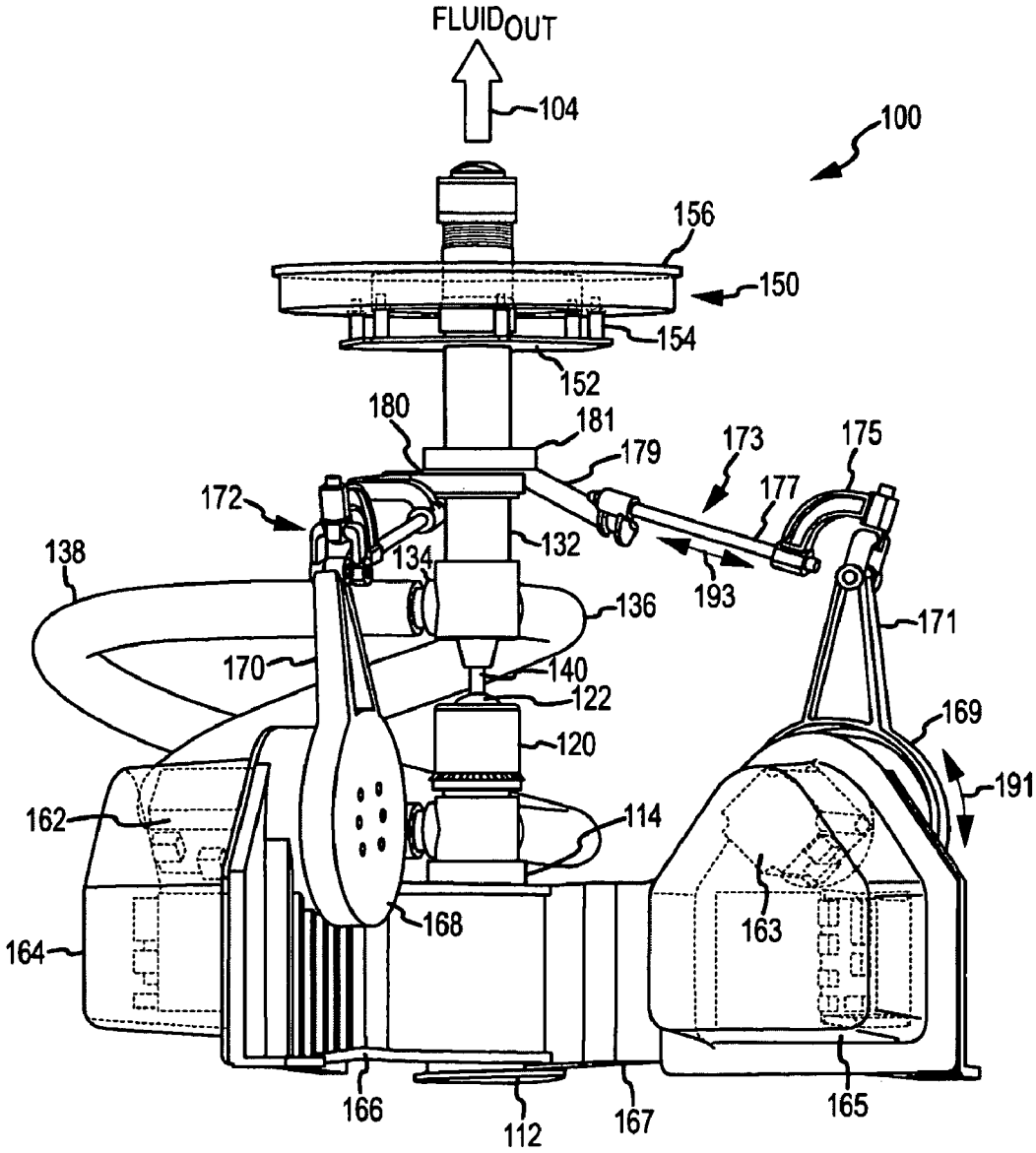
FIGS. 3 and 4 illustrate two additional side views of the fluid effects platform illustrating the use of a pair of drive arms offset by 120 degrees to position a pivotally mounted output or outlet manifold (e.g., a manifold including a nozzle or other outlet device)
Figure 4:
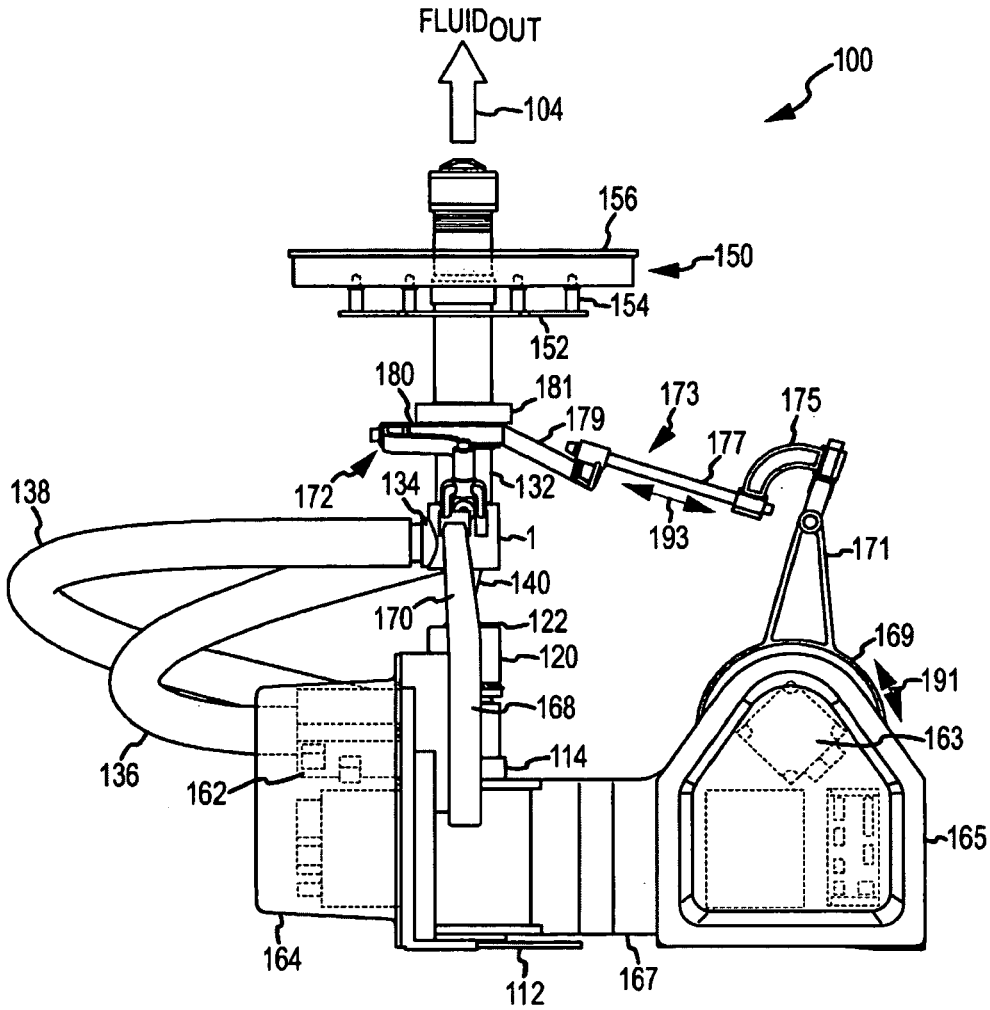

The push rods 172, 173 are each provided as double swing arms to provide relief from side loading of the push rods/pinions 172, 173. As shown in FIG. 2, the push rods 172, 173 generally extend outward from the body 132 of the outlet manifold 130 along a linear path and these paths are offset from each other by the offset angle, θ, which is typically about 120 degrees. As will be appreciated, the drive mechanisms 162, 163 may be separately or concurrently operated to cause the output plates 168, 169 to rotate 190, 191 in either direction and this causes the interconnected push/pull rod assemblies 172, 173 to move linearly 192, 193 to apply a pushing or pulling force to the body 132 at the collars 180, 181. By providing the proper control signals (e.g., based on a set of conical positions or the like) to the drives 162, 163, the body 132 may be pivoted about center point gimbal 122 to selectively and accurately position the nozzle 144.

The assembly 100 provides a compact unit that provides a significant improvement in size and weight. For example, the height and width of the assembly 100 may be less than about 3 feet as compared to water display devices in use that are 5 to 10 feet in height and width. Additionally, it anticipated that the weight of the assembly 100 will be about 50 percent or less of existing devices while still being able to handle a payload (e.g., the outlet manifold 130, nozzle 144, and light ring 150) of up to 50 pounds or more. The manifolds 110, 130 and other structural components may be formed of a variety of materials useful for providing structural strength and, if appropriate, for containing pressurized fluids. The materials typically are also selected to suit the operating environment and conditions such as to resist corrosion when submerged within a body of water or other liquid and for containing a particular fluid such as water or a flammable fluid. In some embodiments, the manifolds 110, 130 are formed from a metal, a metal alloy, or the like while some applications may utilize plastics or other non-metallic materials.

Figure 5:
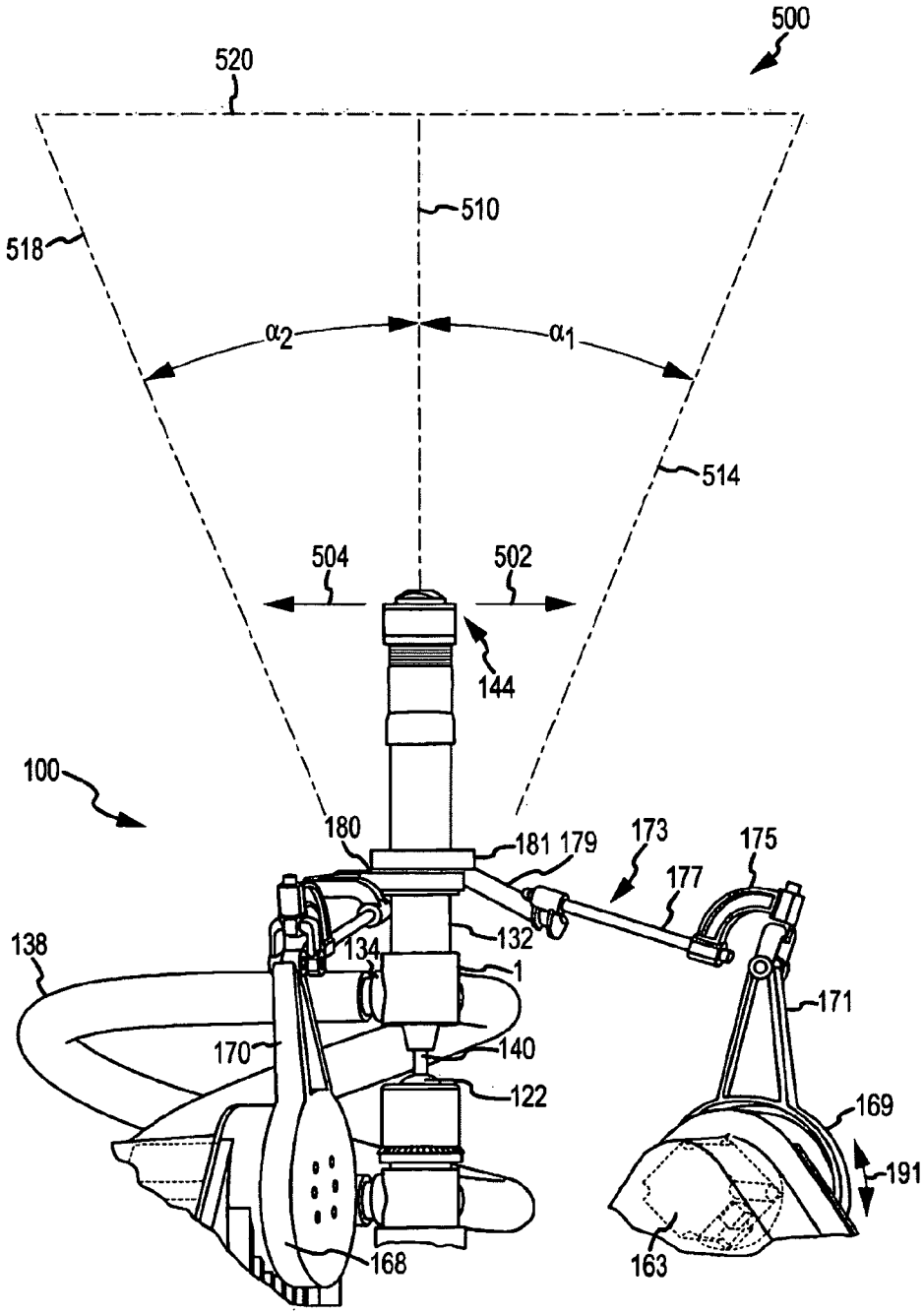
FIGS. 5 and 6 illustrate partial views of the fluid effects platform of FIGS. 1-4 with the cone that may be swept by movement of the output manifold (e.g., fluid nozzle may be thought of as having a conical degree of freedom) by operating the drive assembly to pivot the output manifold on the center point gimbal (e.g., ball joint, for example, or other joint that allows pivoting about a point, upon with the output manifold is mounted or interconnected)
Figure 6:
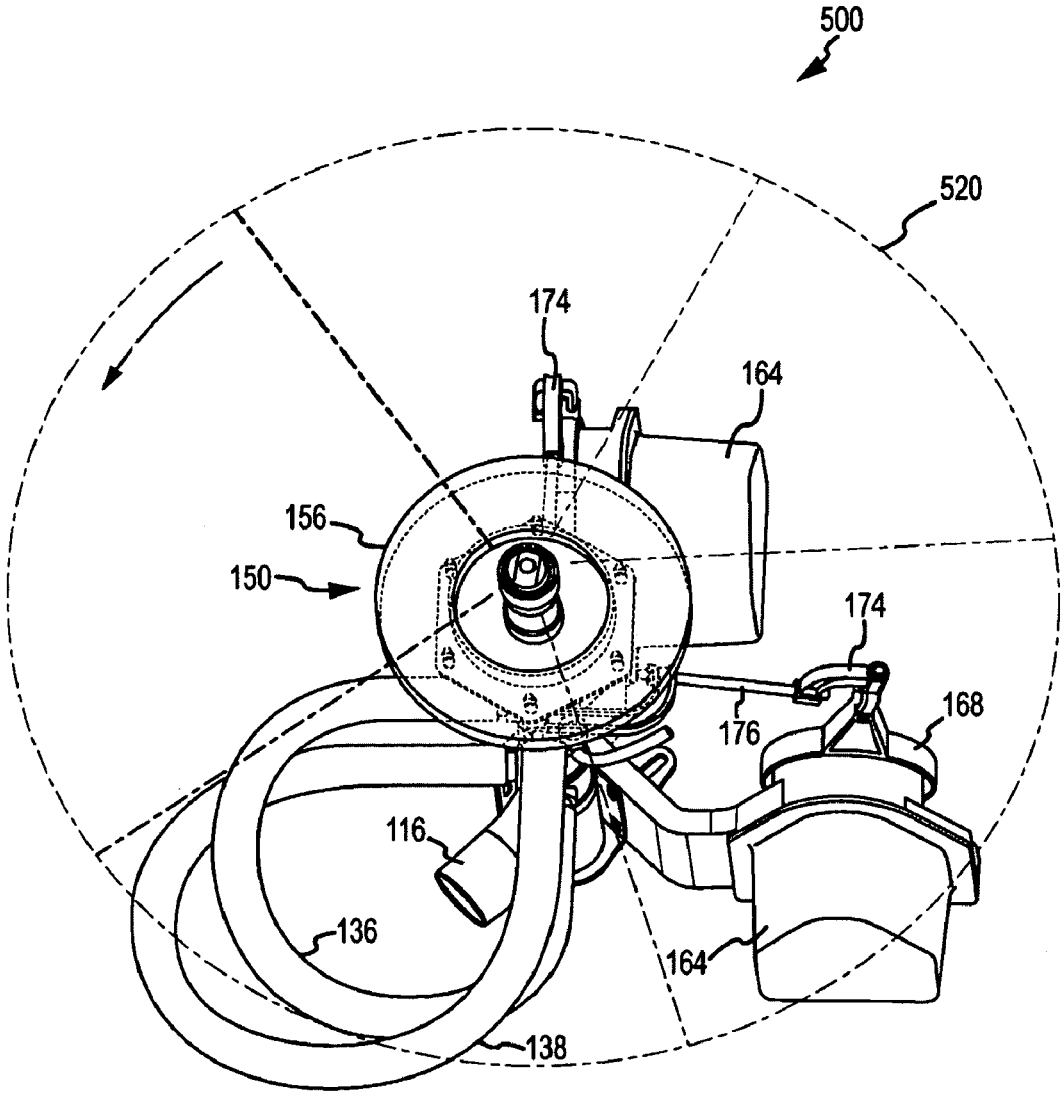

FIGS. 5 and 6 provide a partial view of assembly 100 showing the 3D space 500 in which the outlet manifold 130 may be positioned by operation of the drive assembly 160. As shown, the space 500 is generally an inverted cone or a frustoconical shape. Line 510 extends from the center of the body 132 and, in this case, nozzle 144, and it may coincide with the center axis of the outlet manifold 130 or body 132. The nozzle 144 may be moved by the drive assembly 160 in a first direction 502 (e.g., toward the right in FIG. 5) such as by applying a pulling force by one of push/pull rod assemblies 172, 173. As the nozzle 144 moves it traces or sweeps through an arc and may be moved to an outer limit shown at line 514 (i.e., the center axis of the body 132/nozzle 144 may now be located to coincide with line 514). The line 514 may be considered to be in or coincide with edge or side of a cone 500, and line 514 may be a predefined angle from the center 510 as shown by angular offset, α1, that may in one embodiment be up to about 60 or more degrees with one embodiment setting the maximum angular offset or travel, α1, in any direction at less than about 55 degrees.

Likewise, the nozzle 144 may be moved in a second direction as shown at 504 (e.g., to the left in FIG. 5) by operation of the drive assembly 160 such as by applying a pushing force with one of the push/pull rod assemblies 172, 173. The nozzle 144 again traces an arc as the center axis of the body 132/nozzle 144 moves to a side or edge of the travel space/cone 500 as shown by line 518. This side of the cone 500 may be at an angular offset, $\alpha_2$, from the center 510, which typically match the other angular offset, $\alpha_1$, such as by setting it at 55 degrees (which provides, in this example, a travel path of 110 degrees for the nozzle 140). Surface 520 is intended to represent a base of the cone 500 and shows that the nozzle 144/body 132 of the outlet manifold 130 may move in any direction (e.g., 360 degrees of freedom) from the center 510 (or home position of the nozzle 144/body 132). The assembly 100 may also be balanced or adapted such that its at rest position (e.g., with no additional force being applied by the motors 162, 163 or forces that act to balance the weight of the hoses 136, 138) is at or near center 510 such that the body 132 has its longitudinal axis substantially vertical.

The specific materials and other design characteristics such as many dimensions are generally non-limiting, but it may be useful to provide further design features of an embodiment of the assembly 100. Typically, the payload positioned above the swivel or ball joint 122 is less than about 30 pounds, such as less than 28 pounds for the light ring 150, nozzle 144, and the like, and the center of gravity of this payload may only be a preset distance/offset from the center of pivot ball 122 (e.g., less than about 2 feet such as less than 18-inch offset). Typically, the nozzle 144 will be relatively quickly positionable through its conical degree of freedom (e.g., its 110 degree or the like cone), such as a full in-plane stroke through vertical in less than about 2 seconds, and positioning accuracy (e.g., in pan and tilt) may be less than about 1 degree (e.g., with tilt commands referenced to plumb by a 2-axis inclinometer or the like and pan commands reference to machine base). The castings for the assembly may be stainless steel to provide corrosion resistance while some components (such as wings) may be aluminum or an alloy. The hoses may take a variety of forms but, in some embodiments, are 3-inch flex hose. The overall dimensions may be less than about 4 feet in height for the assembly 100, such as with the ball 122 being at about 2 feet from the base 112, and a width or diameter of less than about 3 feet.

While the nozzle 144 is shown to be a single nozzle, a nozzle assembly may be used in place. For example, it may be desirable to use 2 or more nozzles that are operable concurrently or separately to achieve a desired fountain or display effect. One or both of the nozzles in a dual or multi-nozzle assembly replacing or supplementing nozzle 144 may be air-operated, push/pull valve nozzles or other useful fountain nozzle designs. The nozzles in such an assembly may be targeted in a single direction or multiple directions, and the relationship or relative orientation between the nozzles may be fixed or variable during operation of the assembly 100. A manifold may be provided above or, more typically, below the light ring 150 to supply water/fluid to the nozzles from the hoses 136, 138. The nozzles often will be of differing design to achieve 2 or more effects, and the outlets of the nozzles typically (but not necessarily) will be spaced apart, such as with an offset or spacing of 4 to 8 inches. In some embodiments, the sealed housings (or drive housings) 164, 165 are specially adapted for submerging underneath fluid levels (e.g., up to 6 to 10 feet or more), while maintaining a leak proof/resistant seal. This allows the controls to be submerged and simplifies wiring of the unit 100. The drive in the housings 164, 165 may include a control card, servo drivers, potted connections boxes, heat sinks, and the like, with AC power being supplied via an external connection (e.g., 208 VAC 60 Hz, 3-phase, 10 amp or the like).

The fluid effects assembly 100 of FIGS. 1-6 may be used in a fluid (e.g., water) display or show system 700 as shown in FIG. 7. The system 700 is shown with a single assembly 100, but it should be understood that the system 700 may readily be adapted to include numerous assemblies 100 and the operation of this larger set of assemblies 100 may be synchronized to create a display or show along with the raising and lowering of the assemblies 100 on platforms/frames 770.

To this end, the system includes a computer system 710 that functions as a controller for the system 700 that may be operated to automatically or in response to operator input remotely control the fluid effect assembly 100 including positioning of the nozzle 144 within its conical travel envelope and selectively dispersing fluid 104 from the nozzle 144. The computer system 710 includes a processor 712 for running a show control program (not shown but may be provided in computer-readable medium accessible by processor 712 such as in memory 718) that is adapted to control operation of the assembly 100 and other components of system 700, and the program may generate a GUI 715 on a monitor 714 to allow an operator to enter control commands for the assembly 100, to initiate a set of show commands 719, and/or to adjust operating parameters for the system 700. The processor 712 also manages memory 718 and stores show commands 719 in memory 718 including conical positions 720 of the nozzle 144 (or the body 132 of the outlet manifold 130). In one embodiment, a reverse kinematics algorithm is used to convert input/show commands that are provided in pan/tilt form to conical positions 720 that may be used to selectively drive the push/pull rod assemblies 172, 173 with drive mechanisms 162, 163. The control by computer system 710 may include operating electrical supply 730 to provide power to one or both of the drive mechanisms 162, 163 of fluid effects assembly 100 or may be via wireless signals (e.g., remote operation of DC servo motors with a battery or power source provided in housings 164, 165 of assembly 100).

In one embodiment, an inclinometer is provided such as on the body 132, the nozzle 144, or another useful location/position in or near assembly 100, and the inclinometer transmits signals to the control system 710 for processing by homing module 716. For example, it may desirable for the system 700 to be adapted such that the homing module 716 is periodically run automatically, as part of a pre-show routine in show commands 719, or in response to an operator entering a "home" selection or the like in GUI 715 or by other methods. The homing module 716 works with the inclinometer to automatically determine the present inclination of the body 132 and/or nozzle 144 in respect to gravity (e.g., the position of the longitudinal axis of the body 132 relative to vertical). Specifically, the homing module 716 may query the inclinometer on the assembly 100 and determine the present inclination or tilt, and then operate the drive mechanisms 162, 163 to reset the nozzle 144 at zero inclination in respect to gravity (e.g., by determining a new conical position and necessary movements of the drive mechanisms 162, 163 to achieve this position and a second determination of inclination may be performed after initial reset to assure that zero inclination is achieved). In other embodiments, "home" may not be zero inclination, and the inclinometer and homing module 716 be used to reset the nozzle 144 to this alternative home or offset from vertical.

Water display system 700 may be thought of as being made up of computer system 710, auxiliary services 730, lift linkage assembly 740, pump 780 and fluid effects assembly 100. Computer system 710 operates to control the supply of auxiliary services 730 to the remainder of water display system 700. In the embodiment shown, the remainder of water display system 700 makes use of electrical supply 732 and air supply 734, each having communications links 722 from computer 720. Other services such as fuel (for inclusion of flame in the water display), fire color agents, igniters, light beam coloring wheels, and the like may be included in the auxiliary services 730 and/or on platform 770 or as part of the payload of assembly 100. Communication links 722 may be a direct link through cabling or an indirect link through known methods.

The particular support assembly used along with the lifting assembly 740 may be varied to practice the invention. The assembly 740 shown is shown in U.S. Pat. No. 6,131,810, which is incorporated herein by reference, but other systems and structures may be used to vertically position the assembly 100 relative to a surface of a body of water 702. For example, an assembly similar to that shown in U.S. Pat. No. 6,053,423, which is incorporated herein by reference for all its teaching on supporting and selectively positioning water display devices, may be used in the system 700.

Air supply 734 may be used to supply the force to position platform 770 supporting assembly 100 in two or more vertical positions including an operative or performance position (as shown in FIG. 7), a service position (which may place the platform 770 at, near, or above the surface of the water 702), and the non-operative or non-show position (which typically would place the nozzle 144 lower than shown in FIG. 7 such as fully below the surface of water 702). The lifting/lowering force may be first transmitted to linkage assembly 740 through fluid lines 736 and then converted into motion by linkage assembly 740. By transmitting this controlled motion to platform 770 and assembly 100 through linkage assembly 740, the assembly 100 may be positioned into one of its two or more vertical positions.

As shown in FIG. 7, linkage assembly 740 may be a system of interconnected machine elements, such as cylinders, pistons, pivots, and yokes, used to transmit motion to assembly 100. Linkage assembly 740 may include cylinder 742, piston 744, cylinder 746, piston 748, pin 750, positioning yoke 752, platform link 754, pins 756, fulcrum 758, frame 760, base 764, bolts 766, support frame 770, stabilizing yoke 772, pins 774, and pin 776. Air supply 734 may be connected to both cylinder 742 and cylinder 746 of linkage assembly 740 through the appropriate number of fluid lines, schematically represented by fluid lines 736. To move positioning yoke 752, each cylinder has a piston that may be responsive to air from air supply 734. Piston 744 operates with cylinder 742 and piston 748 operates with cylinder 746. Piston 744 is shown in FIG. 7 under fluid pressure from air supply 734 so as to raise platform 770 and assembly 100 to the performance or show position. Piston 748 is shown in FIG. 7 not under fluid pressure from air supply 734, thus maintaining assembly 100 in the performance position. The supply from air supply 734 may be any service that imparts force to move piston 744 and piston 748, such as air or water. Of course other types of actuators and/or linkages may be used for this purpose as desired. To transmit the vertical motion of piston 748 and piston 744 to assembly 100, piston 748 may be coupled to positioning yoke 752 through pin 750. In turn, positioning yoke 752 may be coupled to assembly platform 770 through platform link 754 at pins 756. To permit raising the assembly 100 in response to lowering one or both of piston 744 and piston 748, positioning yoke 752 may be coupled to fulcrum 758.

Frame 760 provides support for fulcrum 758. Base 764 serves as a stable platform on which frame 760, cylinder 742, and pump 780 may be attached. Base 764 may be fixed to a pool bottom or other structure 790 through, for example, bolts 766. For added control to water display 700, base 764 may be placed upon a computer controlled, motor driven wheeled platform on rails, that serves as a stable platform on which frame 760, performance cylinder 742, and pump 780 may be attached. Support platform 770 is supported by platform link 754 at pins 756 and 774 and serves as a raised platform on which performances or discharges of water or fluid stream 104 are presented based on show commands 719 for example. With pin 776 fixed to frame 760 at a point vertically below fulcrum 758, stabilizing yoke 772 rotates about pin 776 as positioning yoke 752 rotates about fulcrum 758 so as to maintain the known orientation of platform link 754, and thereby maintain the known orientation of support frame or platform 770.

As seen in FIG. 7, pump 780 may be coupled to assembly 100 through flexible hose 782. In some embodiments, pump 780 may be a variable frequency pump so that the velocity and/or pressure of the water flow through nozzle 144 may be controlled by computer 720 through the power supplied from electrical supply 732 to pump 780. Pump 780 is shown in FIG. 7 as a submersible pump residing in a low-lying place within water 702 and attached to base 764. This may be preferable since residing in a low-lying place within water 792 permits pump 780 to be positioned close to the water display and to directly draw from and be cooled by water 792. In small-scale installations, pump 780 may conveniently be placed in a dry room near electrical supply 732 and air supply 734 and use the water 702 as a source or use a different water or fluid source.

The fluid effects assembly (e.g., a water fountain or display device) 100 is believed well suited for many applications as it provides a compact unit that provides accurate positioning of a nozzle. However, it is understood by the inventors that there may be other embodiments of fluid effect devices that will be apparent once the device 100 and its functionality is understood. For example, the device 100 is shown with 2 drives with positioning force input members (rod assemblies 172, 173) that operate along opposing axes that are offset by an angle such as 120 degrees. In other embodiments making use of a pivotally-mounted outlet manifold, additional input members may be provided such as by moving the hoses 136, 138 and providing a third input member and drive mechanism offset by 120 degrees or other offset from the assemblies 172, 173. In other cases, the device 100 may be modified by altering the hose arrangement such as by providing only one hose from the inlet manifold to the outlet manifold or more than 2 (such as 4 looped or bowed hoses). Alternatively, a single inlet hose or line may be used to provide the fluid directly to the outlet manifold with the inlet manifold functioning as a support frame or structure for the center point gimbal (e.g., for providing the ball joint 122) and the attached outlet manifold 130.

Figure 8:
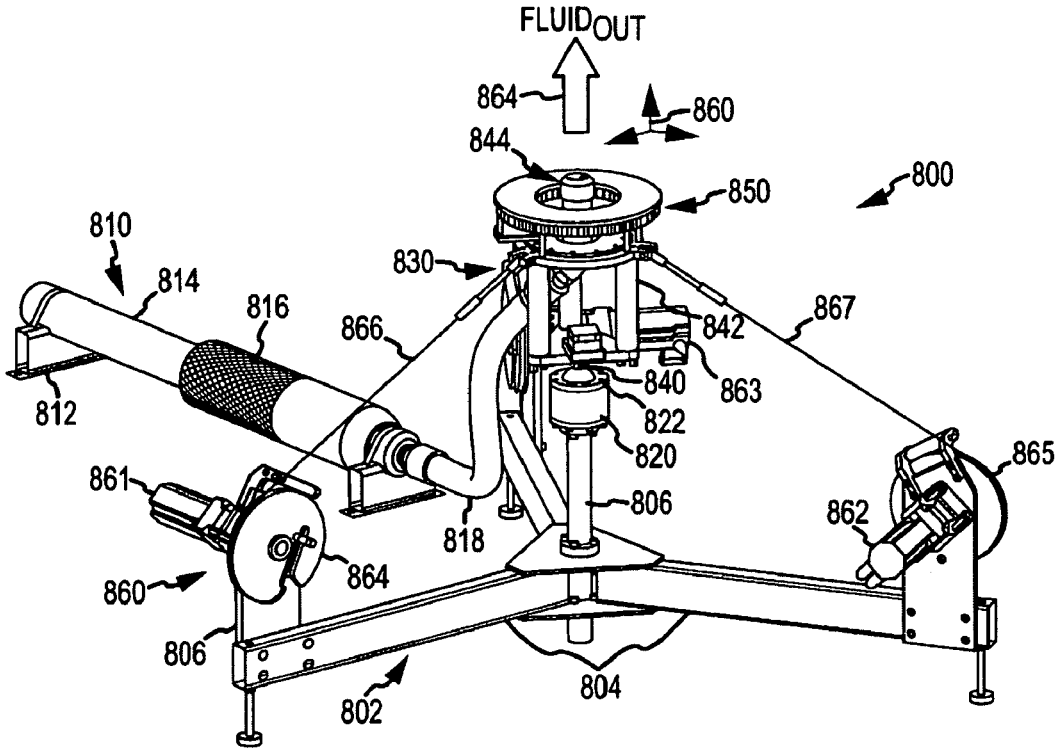
FIGS. 8 and 9 show a perspective and side view of a fluid effects platform or stage of an embodiment of the invention, which may also be labeled a water display device of another embodiment of the invention using three drive arms (e.g., tensioned cables) to selectively position a pivotally mounted outlet manifold with attached nozzle or fluid outlet.

At this point, it may be useful to illustrate another fluid effects assembly 800 with reference to FIG. 8 so as to expand on the idea that the outlet manifold, fluid inlet, drive or positioning system, and other components of a fluid effects assembly may be varied from what is shown in FIGS. 1-7 while still utilizing the pivotal mounting of the outlet manifold to position a nozzle and/or other payload. As shown, the assembly 800 includes a support assembly 802 rather than an inlet manifold as shown in assembly 100. The support assembly 802 includes legs or frame members 804, and the frame members 804 include mounting plates 806 for supporting portions of the drive or positioning assembly 860. The frame members 804 are also used to support a centrally positioned rod or shaft 806. A receiver or support 820 is provided on top of central rod 806 and a center point gimbal such as a ball joint 822 is positioned within the receiver 820 such that the gimbal 822 freely pivots and/or rotates.

The assembly 800 includes an outlet manifold or assembly 830 that is supported upon the gimbal or pivotal joint 822. In this case, the manifold 830 includes a frame 842, which is rigidly connected via rod or pivot pin 840 to the gimbal 822 such that the gimbal 822 moves with frame 840 as shown with arrows 860 (e.g., in multiple directions relative to a center axis or "home" position). The manifold or assembly 830 includes a nozzle 844 through which fluid 864 is discharged to create a fluid (e.g., water) display when the assembly 800 is operated. To provide fluid to the nozzle 844, the assembly 800 includes a fluid supply assembly 810 includes a pump support 812 that may be attached to a positional frame/platform (e.g., frame 770 of FIG. 7 or the like) or to a basin of a body of water. The fluid supply assembly 810 includes a submersible pump (e.g., a 15 HP pump or the like) 814 that draws fluid from the surrounding body of water in which the assembly 800 is placed. A strainer 816 may be provided at the pump outlet to reduce risk of clogging nozzle 844. A hose or line 818 is coupled to the outlet of strainer 816 (or directly to pump 814) at a first end and to an inlet to the nozzle 844 (or to a body of manifold 830 if one is provided for receiving the nozzle 844). The hose 818 is made of flexible material and is arranged with slack to allow it to move with the outlet manifold or assembly 830 during operation of the assembly 800 to position nozzle 844.

A drive or positioning system 860 is provided in the assembly 800 to control or adjust the position of the nozzle 844 relative to vertical (or other home position). As with the assembly 100, the nozzle 844 may be articulated in an arc of up to about 120 degrees with some embodiments allowing 55 degrees of movement in any direction from center (e.g., from an axis extending through the rod 806, through pin 840, and nozzle 844). In contrast to assembly 100, the positioning system 860 includes three drive mechanisms 861, 862, 863 (e.g., submersible servos or the like) that are mounted upon mounting plates 806 and are each operated (separately or concurrently) to rotate three attached cable spools 864, 864. A cable or wire 866, 867 is attached to the spool 864, 865 of the drives 861, 862, 863 at one end and to the outlet manifold or assembly 830 at frame 842. The cables (or positioning force input members) 866, 867 are arranged in assembly 800 such that they are offset from each other by 120 degrees. During operation, the cables 866, 867 are typically under tension to hold the nozzle 844 in a vertical position and the amount of tension is increased or decreased to apply a pulling force on the frame 842, and by operating the drives 861, 862, 863 the tension (or applied force) can be adjusted to cause the frame 842 and attached nozzle 844 to move through a conical space (e.g., see FIGS. 5 and 6).

Figure 9:
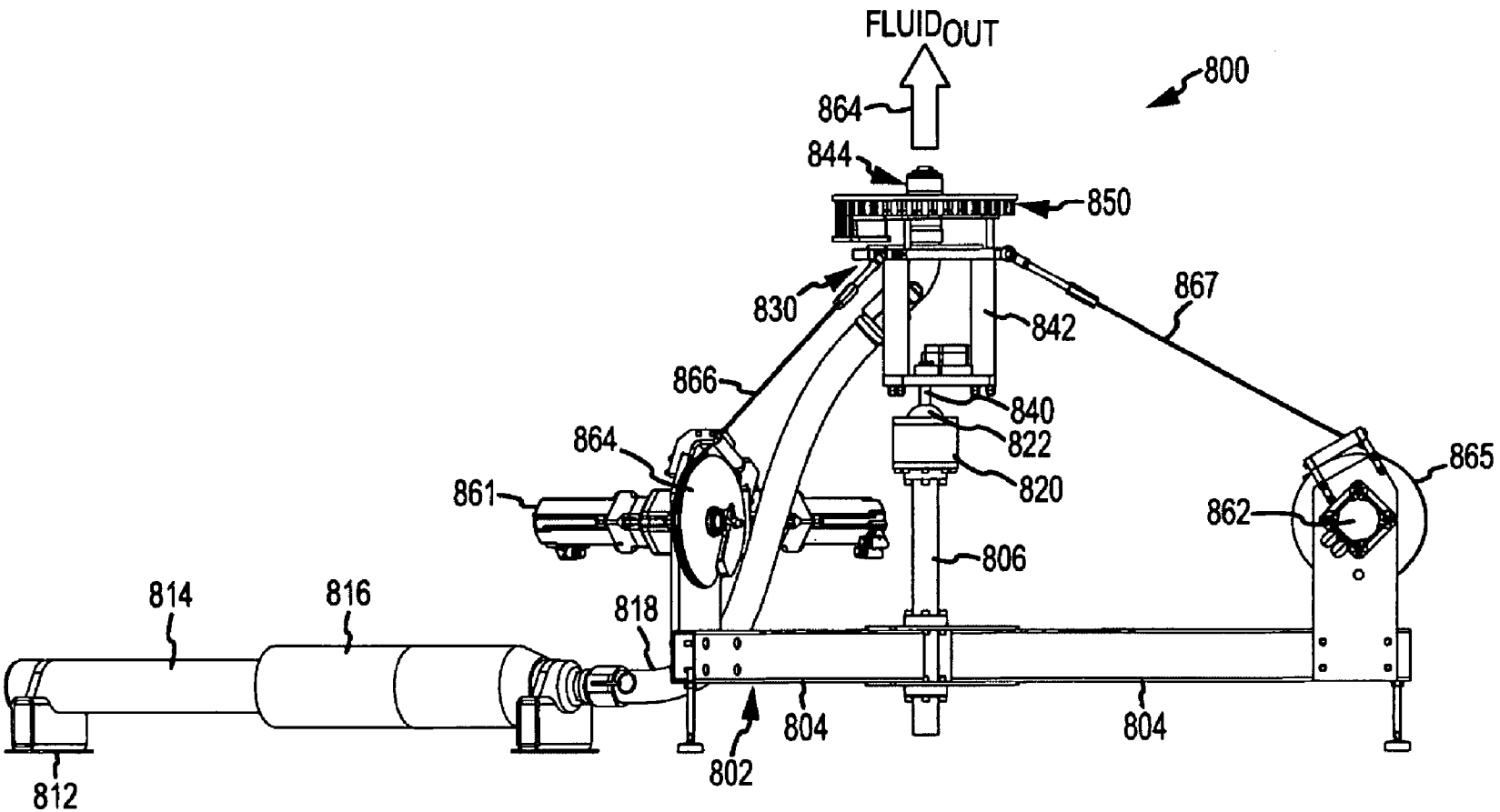
Figures 10A, 10B, 10C:
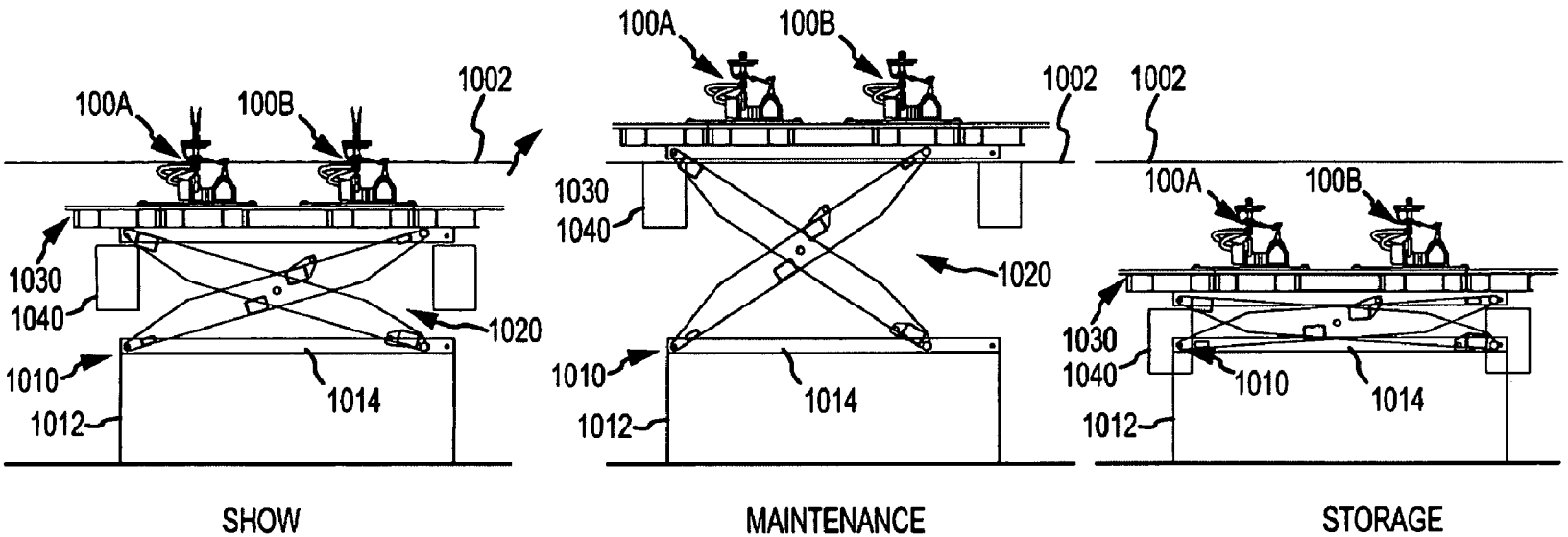
FIGS. 10A-10C illustrate a side view of water display or fountain system that may be used in accordance with an embodiment of the invention (with remote control/operation components not shown for ease of illustration but may include those discussed with reference to FIG. 7 or the like).

As discussed with reference to FIG. 7, the fluid effects assembly 100 of FIG. 1-6 (and other embodiments as shown in FIGS. 8 and 9) may be used in fluid or water displays such as shown in FIG. 7. FIGS. 10A-10C illustrate another show system in which two or more fluid effects assemblies 100A and 100B are selectively positioned relative the surface of a body of water 1002. FIG. 10A illustrates a pair of assemblies 100A, 100B positioned in a show position via fountain positioning assembly 1010. The positioning assembly 1010 includes a base structure 1012 that may be rigidly mounted to the bottom of a lagoon or other man-made or natural reservoir or holding volume for fluid/water 1002. On an upper surface 1014 of the base structure 1012, a linkage assembly 1020 is provided that interconnects the base structure 1012 and a show/mounting table 1030. The effects assemblies 100A, 100B are rigidly attached to an upper surface of the table 1030, and are positioned relative to the surface of fluid/water 1002 via movement of the table 1030.

To this end, the fountain positioning assembly 1010 includes a ballast assembly 1040 (e.g., two or more air/water ballast tanks), which functions to move the table 1030 and attached effects assemblies 100A, 100B from the show position in FIG. 10A to a raised maintenance position shown in FIG. 10B and to a lowered storage position shown in FIG. 10C. In operation, the air/water ballast tanks 1040 do the lifting in the fluid/water 1002 of the table 1030, and remote controls for operating the tanks 1040 and/or the effects assemblies 100A, 100B are not shown, but may take the form as described with reference to FIG. 7 or the like. The linkage assembly 1020 may take on a scissor configuration as shown, and, in some cases, is used for lateral support and/or to fix/lock the height of the table 1030 in the show position of FIG. 10A and the maintenance position of FIG. 10B. The height of the table 1030 and attached/supported fountain assemblies 100A, 100B is maintained relative to the surface of fluid/water 1002 via the ballast system 1040. The height is independent of the level of the lagoon depth from the bottom. When the table 1030 is all the way down in the storage mode as shown in FIG. 10C, the table 1030 and/or the linkage assembly 1020 sits or rests upon the upper surface 1014 of the base or support structure 1012 above the bottom of the lagoon/reservoir/structure containing the fluid/water 1002.

Although the invention has been described and illustrated with a certain degree of particularity, it is understood that the present disclosure has been made only by way of example, and that numerous changes in the combination and arrangement of parts can be resorted to by those skilled in the art without departing from the spirit and scope of the invention, as hereinafter claimed. For example, specific operating parameters may be varied widely to use the fluid effects assemblies of the invention such as varying fluid flow rates and pressures. Likewise, the forces that the cables and rods apply to the outlet manifold (and the corresponding strength of these components to provide these forces/inputs) will typically depend upon the size and weight of a particular outlet manifold, the fluid inlet hosing, fluid pressures, and other parameters, and the invention is not limited to particular configurations of these positioning member/elements (e.g., the push/pull rods 172, 173 of FIGS. 1-4 and positioning cables 866, 867 of FIGS. 8 and 9).

We claim:

1. A fluid effects apparatus, comprising:

a base with a center point gimbal mechanism;

a fluid outlet manifold with an inlet for receiving fluid and an outlet device for dispersing the received fluid, wherein the fluid outlet manifold is supported upon the center point gimbal mechanism to move with the center point gimbal mechanism and with a center axis of the fluid outlet manifold extending through the center point gimbal mechanism; and a drive assembly with a first drive mechanism driving an input arm attached to the fluid outlet manifold and a second drive mechanism driving an input arm attached to the fluid outlet manifold at a predefined offset angle, wherein the first and second drive mechanisms are separately and concurrently operable to move the input arms to pivot the fluid outlet manifold on the center point gimbal mechanism to selectively position the outlet device.

2. The apparatus of claim 1, wherein the center point gimbal mechanism comprises a ball joint and wherein the fluid outlet manifold is rigidly connected to the ball joint.

3. A fluid effects apparatus, comprising:

a base with a center point gimbal mechanism;

a fluid outlet manifold with an inlet for receiving fluid and an outlet device for dispersing the received fluid, wherein the fluid outlet manifold is supported upon the center point gimbal mechanism; and a drive assembly with a first drive mechanism driving an input arm attached to the fluid outlet manifold and a second drive mechanism driving an input arm attached to the fluid outlet manifold at a predefined offset angle, wherein the first and second drive mechanisms are separately and concurrently operable to move the input arms to pivot the fluid outlet manifold on the center point gimbal mechanism to selectively position the outlet device and wherein the offset angle between the input arms is about 120 degrees.

4. The apparatus of claim 3, wherein the input arms apply an input force to the fluid outlet manifold along a linear path when driven by the drive mechanisms.

5. The apparatus of claim 3, wherein the drive assembly further comprises a third drive mechanism driving an input arm attached to the fluid outlet manifold at an offset angle of about 120 degrees from the input arms of the first and second drive mechanisms.

6. The apparatus of claim 1, wherein the outlet device has a range of motion on the center point gimbal mechanism that is a predefined angular offset in all directions from a center axis extending through the outlet device.

7. The apparatus of claim 6, wherein the predefined angular offset is at least about 55 degrees.

8. The apparatus of claim 1, wherein the base comprises a fluid inlet manifold with an inlet for receiving pressurized fluid and at least two outlets for discharging the received pressurized fluid, further including at least two flexible hoses connecting the at least two outlets to the inlet of the fluid outlet manifold, and wherein the hoses have a center of gravity that is positioned at an offset angle of about 120 degrees from the input arms of the drive mechanisms.

9. A fluid display system, comprising:

a control system comprising memory storing a set of show commands including conical positions;

a plurality of lift mechanisms with a vertically positionable platform; and on each of the platforms, a fluid effects assembly comprising an outlet manifold pivotally supported on a base and a drive assembly with a pair of drives independent and concurrently operable to drive a pair of arms attached to the outlet manifold, the arms extending along opposing axes that are spaced apart by about 120 degrees, wherein the outlet manifold comprises a nozzle and the control system operates during a show operation to cause the lift mechanisms to position each of the platforms at one or more vertical positions and to cause the drives of each of the fluid effects assemblies to move the arms to position a nozzle in the outlet manifold in the conical positions.

10. The system of claim 9, wherein the nozzle is articulable up to 55 degrees in all directions from a center axis and the conical positions are selected to move the nozzle to points on a semi-spherical surface traced by articulation of the nozzle from the center axis.

11. The system of claim 9, wherein the control system further includes a homing module and each of the fluid effects assemblies comprises an inclinometer mounted on the outlet manifold and communicating tilt data to the homing module and wherein the homing module operates prior to the show operation to determine a location of a center axis of the nozzle relative to vertical and to alter the center axis location to home the center axis of the nozzle to zero inclination relative to gravity by operating the drive assembly to pivot the outlet manifold on the base.

12. The system of claim 9, wherein the base comprises a ball joint and the outlet manifold is affixed to the ball joint with a connector.

13. The system of claim 12, wherein the base comprises a fluid inlet manifold with an inlet for receiving fluid and a pair of outlets and wherein the fluid effects assemblies each further include a pair of flexible hoses extending from the outlets to a pair of inlets on the fluid outlet manifold.

14. A water display assembly, comprising:

a fluid inlet manifold with a fluid inlet and a pair of fluid outlets;

a fluid outlet manifold with a pair of fluid inlets and a nozzle for discharging fluid received via the fluid inlets, the fluid outlet manifold being pivotally mounted upon the fluid inlet manifold at a position above the fluid outlets;

a pair of flexible hoses connected to the fluid outlets and the fluid inlets; and a drive assembly comprising first and second drive arms attached to the fluid outlet manifold and offset from each other by about 120 degrees as measured relative to a center axis of the outlet manifold, wherein the drive assembly further includes a pair of drive mechanisms operable to move the drive arms to articulate and selectively position the nozzle.

15. The assembly of claim 14, wherein the drive mechanisms comprise motors that are independently and concurrently operable to move the drive arms to position the nozzle.

16. The assembly of claim 14, wherein the outlet manifold is pivotal in any direction to angular offsets of up to at least 55 degrees as measured from a center axis extending through a pivot point on the base and the outlet manifold.

17. The assembly of claim 14, wherein the fluid inlet manifold further comprises a ball joint and wherein the fluid outlet manifold is directly connected to the ball joint to provide the pivotal mounting.

18. The assembly of claim 14, wherein the hoses are each arranged in a partial loop and the loops cross between the fluid inlet manifold and the fluid outlet manifold, whereby the hoses are self-managing with reference to loads applied upon the fluid outlet manifold.

19. The assembly of claim 18, wherein the hoses have a center of gravity that is positioned at an offset of about 120 degrees from each of the drive arms.

20. The assembly of claim 14, wherein the drive arms each comprise a pair of swing arms and wherein the drive mechanisms each comprise motors providing angular motion to a drive plate linked to the swing arms.

21. The assembly of claim 1, wherein the input arms move linearly to apply a pushing or pulling force on the fluid outlet manifold.

* * * * *